US007200896B1

(12) United States Patent
Chen

(10) Patent No.: US 7,200,896 B1
(45) Date of Patent: Apr. 10, 2007

(54) TWIN-BAR PULL HANDLE WITH TWO STOP BUTTONS

(76) Inventor: Shou Mao Chen, No. 344, Sec. 1, Chung Shan Road, Ta Cha Township, Taichung Hsien (TW)

( * ) Notice: Subject to any disclaimer, the term of this patent is extended or adjusted under 35 U.S.C. 154(b) by 108 days.

(21) Appl. No.: 11/051,103

(22) Filed: Feb. 7, 2005

(51) Int. Cl.
*B25G 1/04* (2006.01)
*A45C 7/00* (2006.01)

(52) U.S. Cl. ..... 16/113.1

(58) Field of Classification Search ..... 16/113.1, 16/405, 429, 114.1; 403/323–325, 109.1, 403/109.2, 109.3, 109.8; 280/655, 655.1, 280/47.371, 47.315; 190/18 A, 115
See application file for complete search history.

(56) References Cited

U.S. PATENT DOCUMENTS 5,581,846 A * 12/1996 Wang ..... 16/113.1
5,630,250 A * 5/1997 Chou ..... 16/113.1
5,727,898 A * 3/1998 Lu ..... 403/325
5,781,965 A * 7/1998 Lu ..... 16/113.1
5,862,898 A * 1/1999 Chang ..... 190/115
6,061,871 A * 5/2000 Wang ..... 16/113.1
6,226,834 B1 * 5/2001 Lu ..... 16/113.1
6,332,242 B1 * 12/2001 Chen ..... 16/113.1
6,470,529 B1 * 10/2002 Chang ..... 16/113.1
6,830,135 B2 * 12/2004 Lin et al. ..... 190/115
6,920,666 B1 * 7/2005 Chen ..... 16/113.1
6,978,514 B2 * 12/2005 Kuo et al. ..... 16/113.1
2001/0032374 A1 * 10/2001 Kuo ..... 16/113.1
2002/0014382 A1 * 2/2002 Kuo ..... 190/115
2003/0084541 A1 * 5/2003 Liang ..... 16/113.1

FOREIGN PATENT DOCUMENTS

FR 2722667 A3 * 1/1996

* cited by examiner

*Primary Examiner*—Chuck Y. Mah
(74) *Attorney, Agent, or Firm*—Egbert Law Offices

(57) ABSTRACT

The twin-bar pull handle with two stop buttons includes a twin-bar pull handle, two stop buttons and two brake rods. The twin-bar pull handle has two riser pipes, a transverse holding rod and a hollow horizontal tube with both sides connected to the top of two riser pipes. Two stop buttons are separately placed at both sides of transverse holding rod, and a spinner is provided at exterior of stop button for pressing. Two brake rods are separately placed into two riser pipes, with the bottom connected to the fixation member of pull handle that allows downward shift to release the fixation member for flexible operation of pull handle. The two contact legs enable the top to be connected separately to the top of spinners of two stop buttons, and the bottom to protrude towards the top of two brake rods. A shared rotating drive element, which is transversely placed inside the hollow horizontal tube, comprises a rotation axis and two swinging sheets.

2 Claims, 9 Drawing Sheets

TWIN-BAR PULL HANDLE WITH TWO STOP BUTTONS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a twin-bar pull handle, and more particularly to an innovative pull handle that is designed with two stop buttons of an activating mechanism for a controlled operation.

BACKGROUND OF THE INVENTION

The pull handles of luggage currently available are generally designed with a flexible structure, wherein the stop button is mounted at the top of pull handle for release of fixation, and then transferred to the fixation position of pull handle via drive mechanism. In either single-bar or twin-bar configuration, the conventional luggage pull handle is designed with a single stop button at the top center of pull handle. Since manual holding of pull handle often generates the sense of mishandling, the operators in this industry have developed a structure that two stop buttons are separately placed at both sides of the top of pull handle. However, such a twin-stop button structure is exclusively designed for the spatial configuration of single-bar pull handle. Thanks to robust construction, twin-bar pull handles are generally applied to medium or high-grade luggage with an extremely high market share. So, with intention to apply twin-stop button structure to this twin-bar pull handle, there's no doubt that a braking and drive mechanism for the special configuration shall be developed for a smooth operation.

Thus, to overcome the aforementioned problems of the prior art, it would be an advancement in the art to provide a twin-button drive mechanism exclusively for the twin-bar pull handle.

BRIEF SUMMARY OF THE INVENTION

The present invention is directed to a twin-button braking mechanism exclusively designed for twin-bar pull handle. Thanks to the simple configuration and model design of a shared rotating drive element 50 along with two contact legs 41 42, it is possible to achieve an ease-of-manufacturing and installation for mass production with higher economic efficiency. During the driving process, a smooth and accurate drive can be made possible by pressing the contact legs in conjunction with the swinging action of shared rotating drive element.

The above is a detailed description of the technical features of the present invention based on a typical preferred embodiment. However, it should be appreciated that the present invention is capable of a variety of embodiments and various modifications by those skilled in the art, and all such variations or changes shall be embraced within the scope of the following claims.

DETAILED DESCRIPTION OF THE INVENTION

Figure 1:
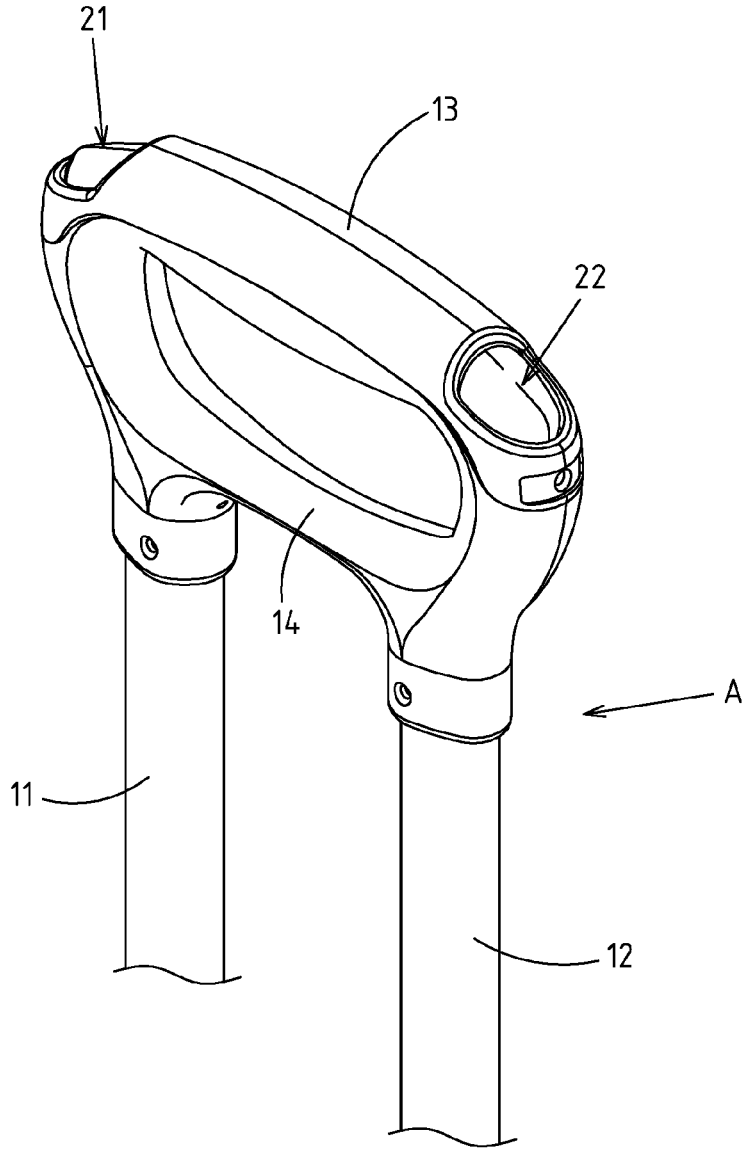
FIG. 1 shows a perspective view of the exterior of the pull handle.
Figure 2:
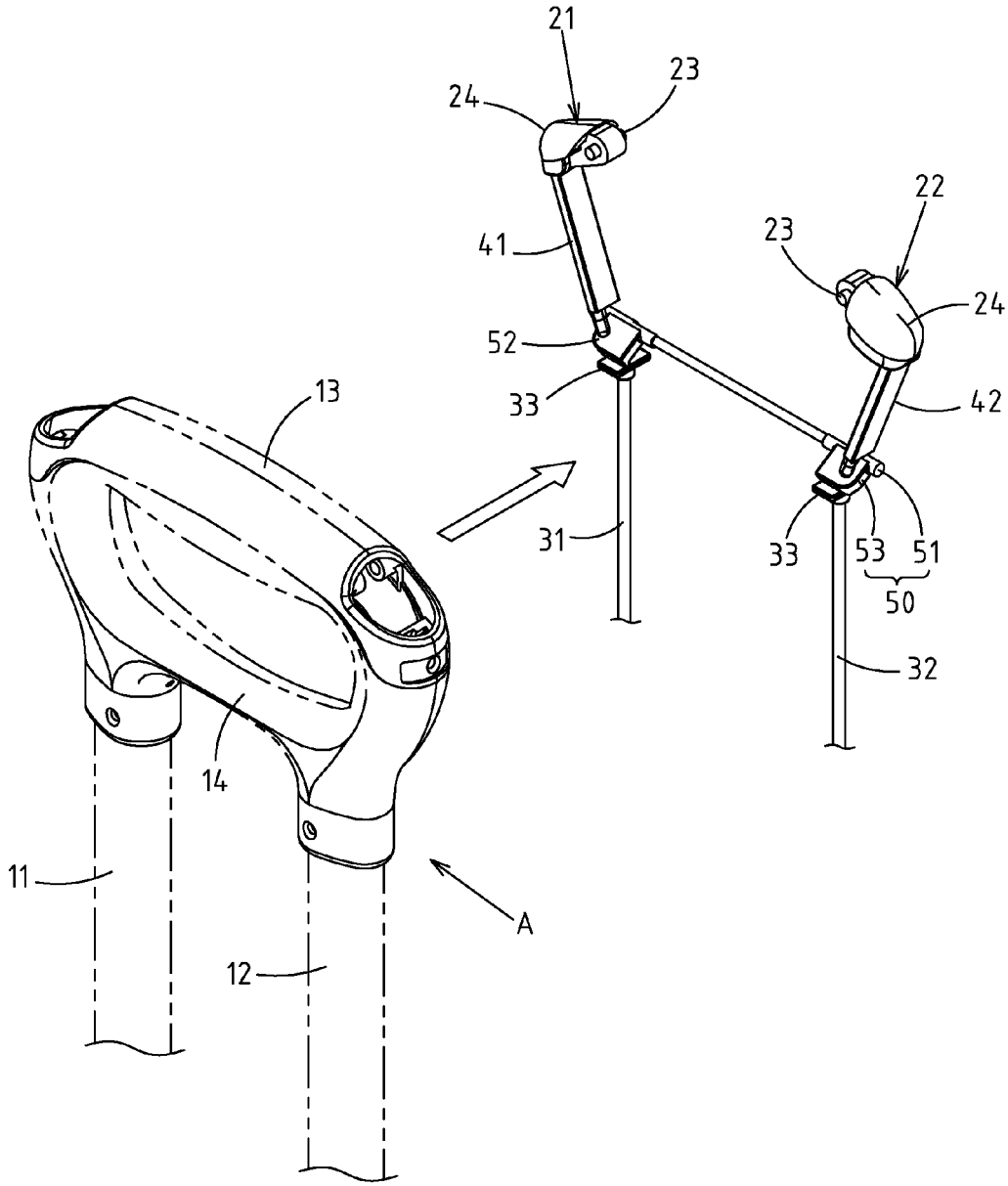
FIG. 2 shows a perspective view of the internal braking structure of the pull handle.

The features and the advantages of the present invention will be more readily understood upon a thoughtful deliberation of the following detailed description of a preferred embodiment of the present invention with reference to the accompanying drawings.

As shown in FIGS. 1–4, there is a twin-bar pull handle with two stop buttons for luggage embodied in the present invention.

The invention includes a twin-bar pull handle A, which comprises two spaced riser pipes 11 12, a transverse holding rod 13 linked to the top of two riser pipes and a hollow horizontal tube 14 placed at lower space of transverse holding rod 13. Both sides of the hollow horizontal tube 14 are internally connected to the top of two riser pipes 11 12.

Two stop buttons 21 22 are separately mounted at both sides of transverse holding rod 13 of twin-bar pull handle. A pivot point 23 is provided at inner side of two stop buttons, and a spinner 24 at outer side for manual pressing.

Two brake rods 31 32 are separately placed into two riser pipes 11 12 of twin-bar pull handle, with its bottom connected to the preset fixation member no drawing available of pull handle. So, the pull handle can be operated flexibly by releasing the fixation members via downward shift of two brake rods (this part is provided with the same fixation member as that of conventional luggage pull handle, so no detailed description is necessary).

The invention also includes two contact legs 41 42, with the top connected separately to the top of spinners 24 of two stop buttons 21 22, and the bottom protruding towards the top of two brake rods 31 32.

A shared rotating drive element 50 is transversely placed inside the hollow interior of hollow horizontal tube 14 of twin-bar pull handle, comprises a rotation axis 51 and two swinging sheets 52 53. The pull handle body is connected and limited at both sides of rotation axis 51, making it possible to rotate around the fixed point of horizontal shaft. Two swinging sheets 52 53 are separately fixed at both sides of rotation axis 51, presenting a lateral stretching state. In this way, two aforementioned contact legs 41 42 are separately stopped at top of two swinging sheets 52 53, while the top of two aforementioned brake rods 31 32 is separately stopped at the bottom of two swinging sheets 52 53.

Based on the above-specified structure and composition, the twin-button drive mechanism of twin-bar pull handle can function as detailed below.

Figure 3:
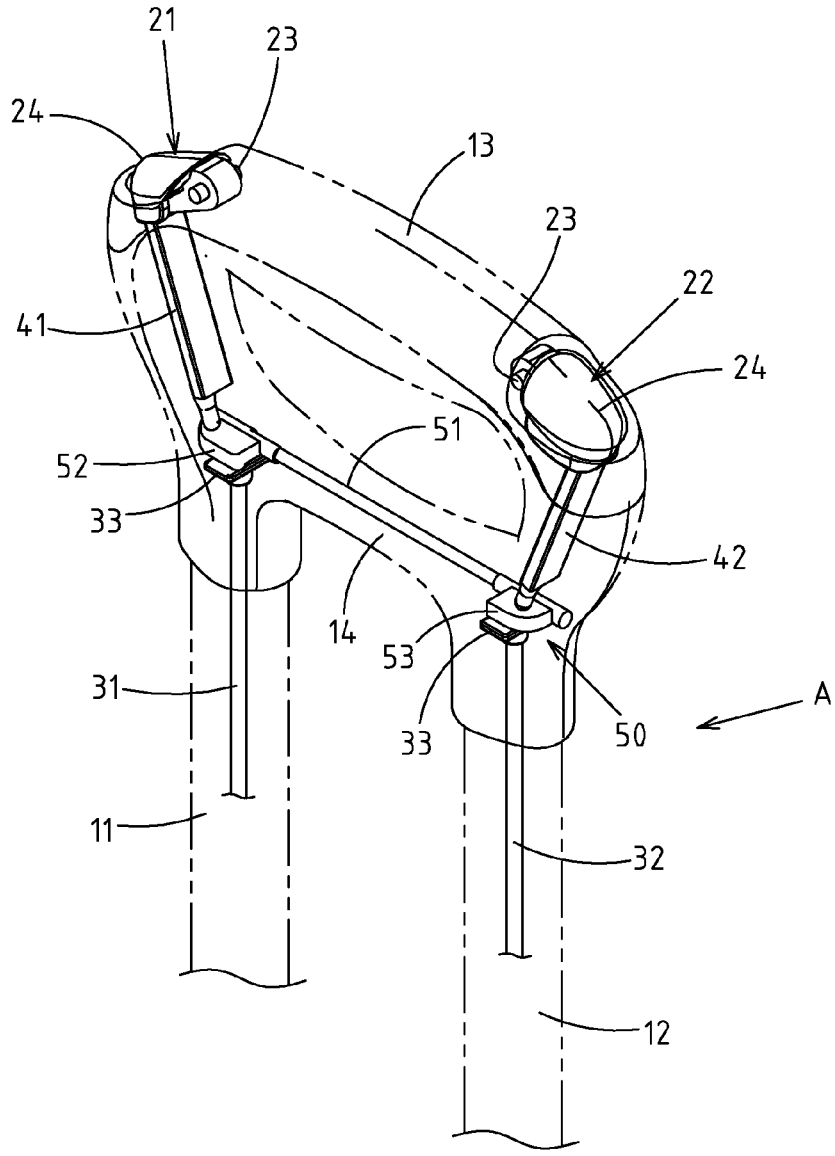
FIG. 3 shows a perspective view of the internal structure of the pull handle, before pressing the stop buttons.
Figure 4:
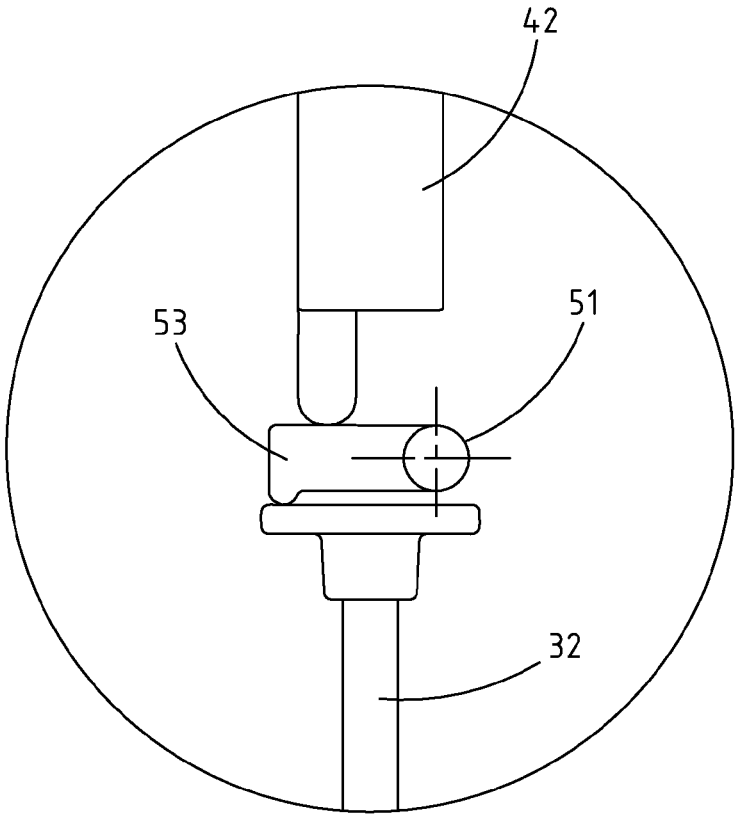
FIG. 4 shows an isolated elevation view of the local internal structure of the pull handle, before pressing the stop buttons.

As shown in FIGS. 3–4, when the user hasn't pressed the stop button, two swinging sheets 52 53 and two contact legs 41 42 of shared rotating drive element 50 can be supported by the upward reset characteristics of lower two brake rods 31 32, thus presenting a rising spinner 24 of two stop buttons 21 22.

Figure 5:
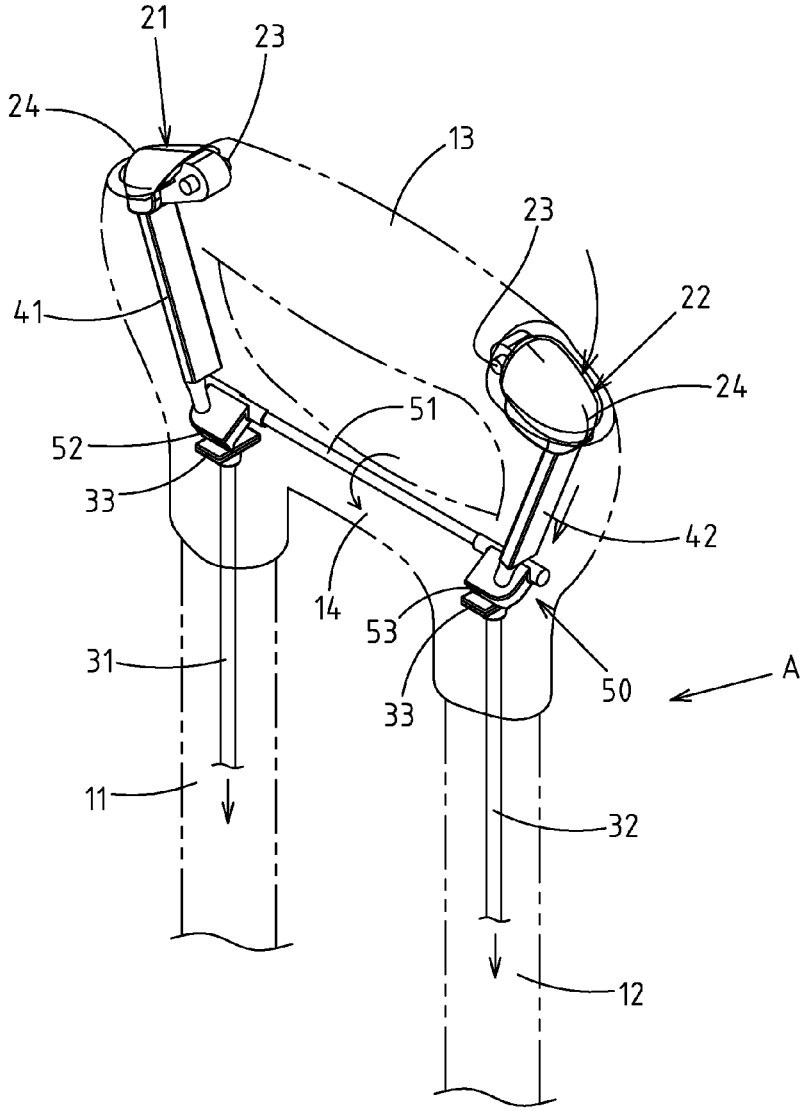
FIG. 5 shows a perspective view of the internal structure of the pull handle, when pressing the right stop button.
Figure 6:
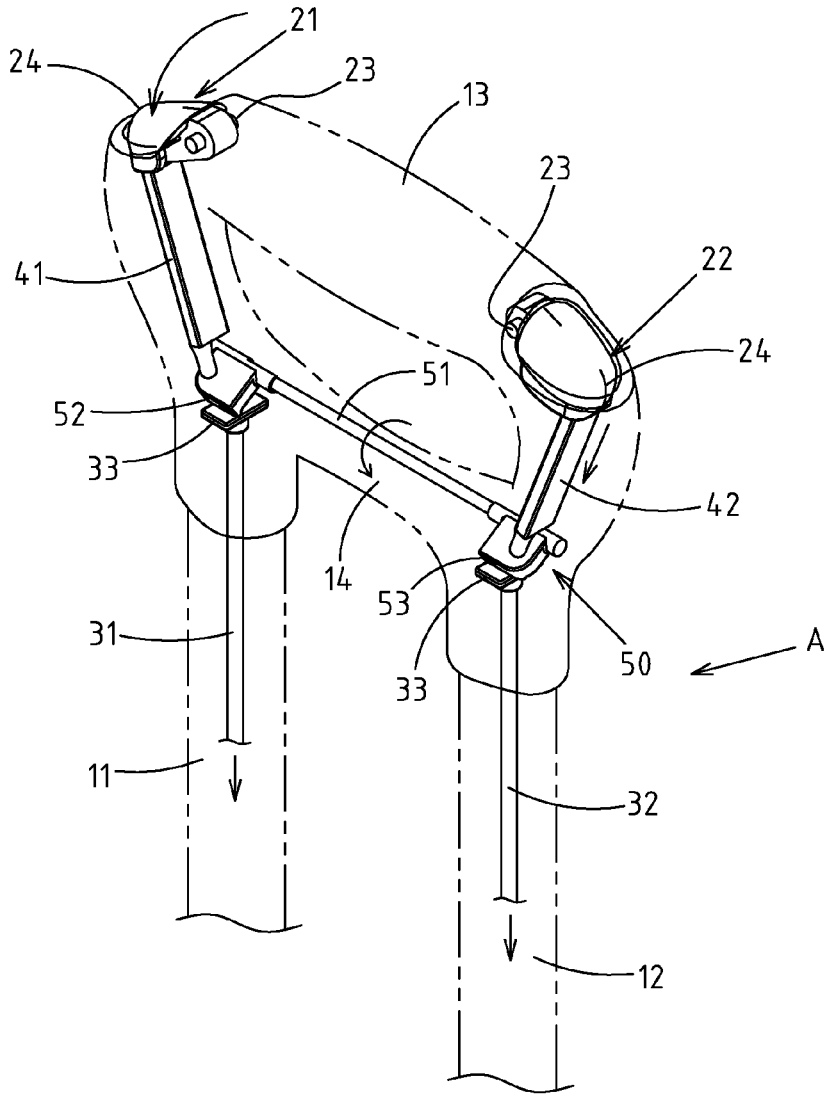
FIG. 6 shows a perspective view of the internal structure of the pull handle, when pressing the left stop button.
Figure 7:
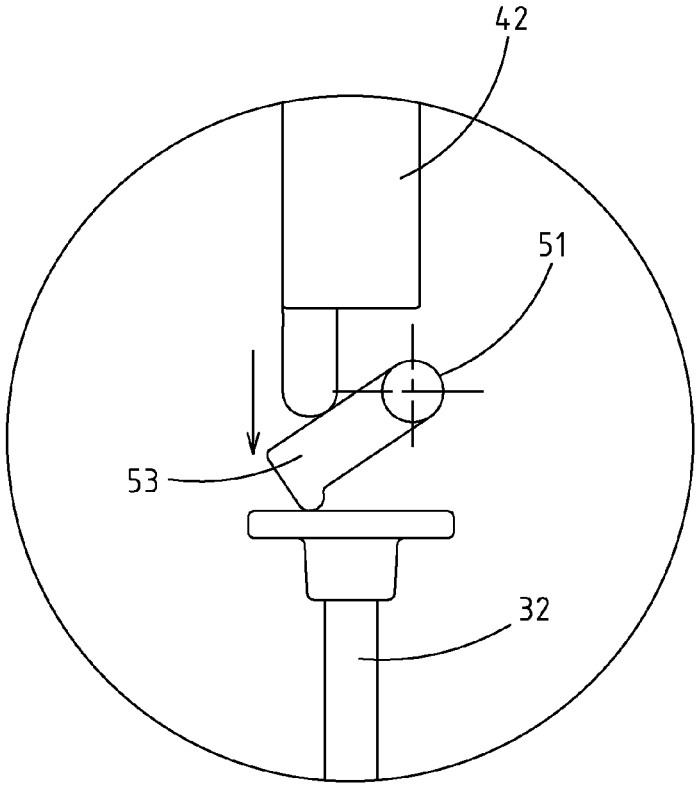
FIG. 7 shows an isolated elevation view of the local internal structure of the pull handle, when pressing the stop buttons.
Figure 8:
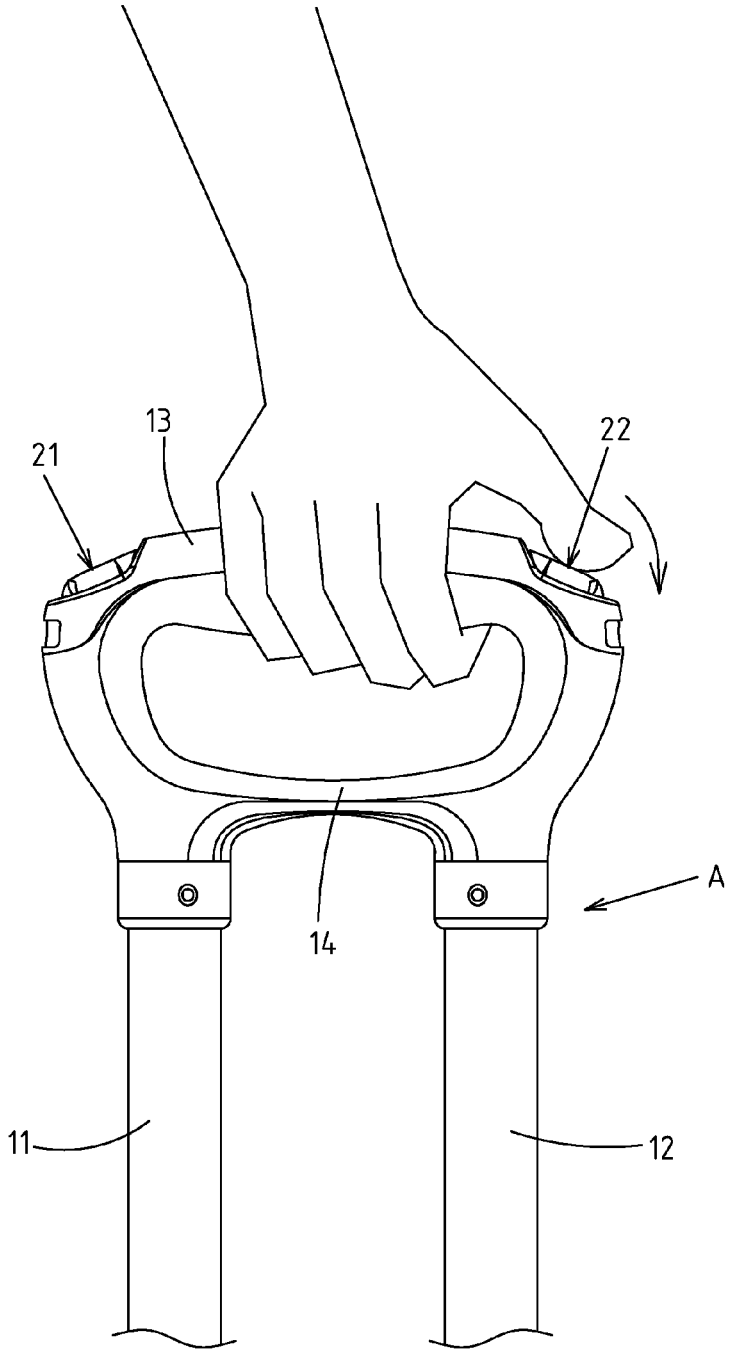
FIG. 8 shows an elevation view when the user is pressing the right stop button with the right hand.
Figure 9:
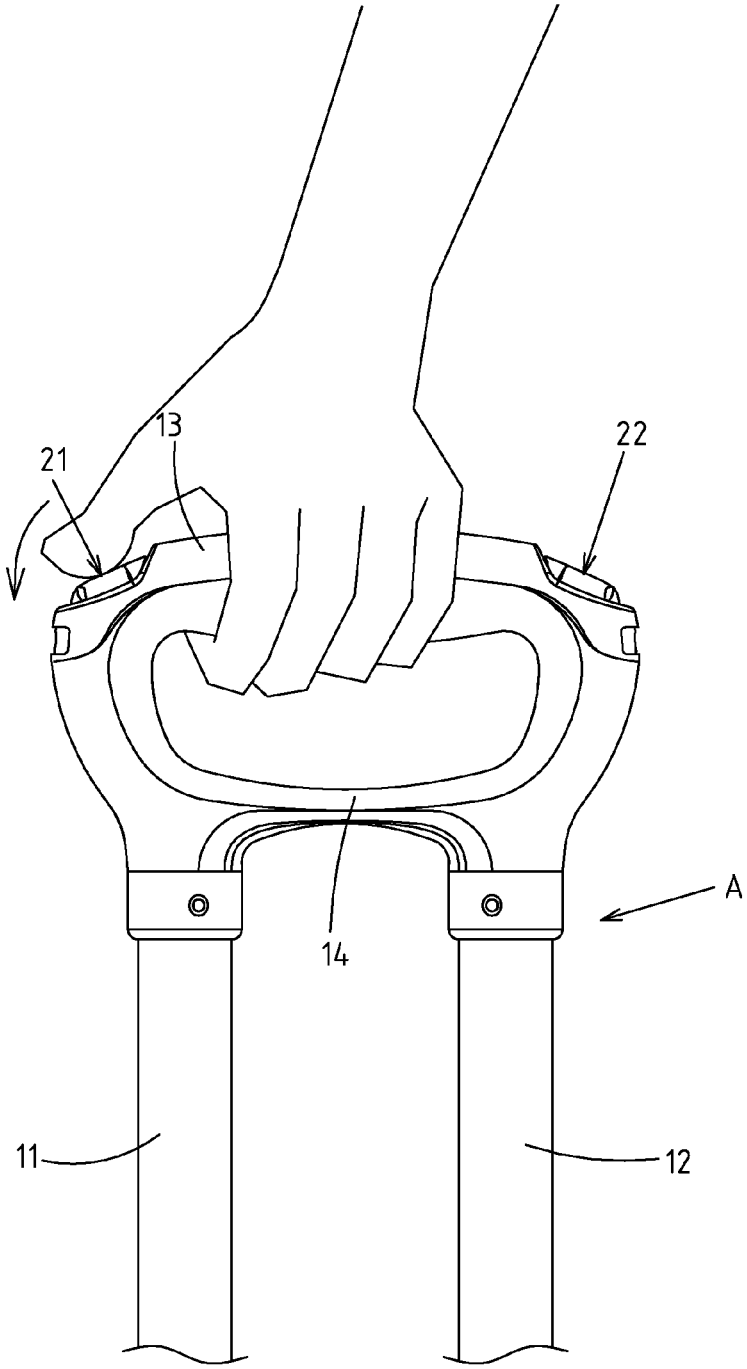
FIG. 9 shows an elevation view when the user is pressing the left stop button with the left hand.

As shown in FIGS. 5–6, whenever the user presses either group of stop button 21 or 22, or press both of them simultaneously, the rotation axis 51 of a shared rotating drive element 50 can be enabled to rotate via the interconnected contact leg 41 or 42. Moreover, the rotary swinging sheets 52 53 at both sides can be synchronized and pressed down, thus activating two brake rods 31 32 to shift downwards. As shown in FIGS. 8–9, the user can drive two brake rods 31 32 simultaneously by pressing stop button 22 or 21 via either left or right hand.

Of which, the top surface of two brake rods 31 32 can be designed with an expanded plate 33 fixed at the bottom of two swinging sheets 52 53.

Of which, two swinging sheets 52 53 and rotation axis 51 of the shared rotating drive element 50 can be integrally preformed, or provided with a fixed structure.

The contact legs 41 42 and stop buttons 21 22 can be integrally preformed, or provided with a fixed structure.

I claim:

1. A handle assembly comprising:

a pull handle having a pair of riser pipes extending in spaced relation to each other, said pull handle having a transverse holding rod linked to a top of said pair of riser pipes, said pull handle having a hollow horizontal tube extending between and internally connected to said pair of riser pipes below said transverse holding rod;

a pair of stop buttons respectively mounted at opposite end of said transverse holding rod, each of said of stop buttons having a pivot point on an inner side thereof, each of said pair of stop buttons having a spinner at an outer side thereof;

a pair of brake rods respectively positioned in said pair of riser pipes;

a pair of contact legs having a top respectively connected to a top of said spinner of said pair of stop buttons, said pair of contact legs each having a bottom extending to a respective top of said pair of brake rods;

a drive element extending through an interior of said hollow horizontal tube, said drive element having a rotatable axle with a pair of swinging sheets respectively affixed to ends of said rotatable axle, said ends of said rotatable axle mounted in said pull handle, said pair of swinging sheets being fixed respectively at said ends of said rotatable axle, said pair of contact legs stopped respectively at a top of said pair of swinging sheets, said pair of brake rods respectively stopped at a bottom of said pair of swinging sheets.

2. The handle assembly of claim 1, said pair of brake rods respectively having an expanded plate fixed at said bottom of said pair of swinging sheets.

* * * * *